US006520574B1

(12) United States Patent
Huang

(10) Patent No.: US 6,520,574 B1
(45) Date of Patent: Feb. 18, 2003

(54) BEACH CHAIR WITH A SUNSHADE

(76) Inventor: Hsi-Chin Huang, No. 181, Wentzu Rd., Hsienhsi Hsiang, Changhua Hsien (TW)

( * ) Notice: Subject to any disclaimer, the term of this patent is extended or adjusted under 35 U.S.C. 154(b) by 0 days.

(21) Appl. No.: 10/144,502

(22) Filed: May 13, 2002

(51) Int. Cl.[7] ..... A47C 7/66
(52) U.S. Cl. ..... 297/184.16; 248/515; 403/84
(58) Field of Search ..... 297/184.16; 248/514, 248/515, 334; 403/83, 84, 87, 96, 97, 290

(56) References Cited

U.S. PATENT DOCUMENTS 3,050,280 A * 8/1962 Regan ..... 248/514
4,809,724 A * 3/1989 Fuser ..... 297/184.16
5,110,184 A * 5/1992 Stein et al. ..... 297/184.16
5,350,215 A * 9/1994 DeMars ..... 297/184.16
6,216,317 B1 * 4/2001 Chen ..... 403/84
6,409,411 B1 * 6/2002 Crorey ..... 403/97

* cited by examiner

*Primary Examiner*—Peter R. Brown
(74) *Attorney, Agent, or Firm*—William E. Pelton, Esq.

(57) ABSTRACT

A beach chair with a sunshade in accordance with the present invention consists of a chair (10), a sunshade (20) and a securing device (30) mounted between the chair (10) and the sunshade (20). The securing device (30) comprises a toothed ring (31) mounted on the chair (10), a locking collar (32) rotatably mounted around the toothed ring (31), a locking block (33) rotatably secured inside the locking collar (32) and a ratchet wheel (34) holding the sunshade (20) and rotatably mounted on the locking collar (32). The sunshade (20) can be moved in two directions by operationally rotating the ratchet wheel (34) relative to the locking collar (32) and rotating the locking collar (32) round the toothed ring (31) to achieve an optimum inclination position for shading. Additionally, the sunshade (20) can be folded against the chair (10) so the beach chair can be easily carried.

10 Claims, 8 Drawing Sheets

BEACH CHAIR WITH A SUNSHADE

BACKGROUND OF THE INVENTION

1. Field of the Invention

The present invention relates to a beach chair, and more particularly to a foldable beach chair to which a sunshade is attached, where the inclined angle of the sunshade can be adjusted to correspond to the inclination of the sun.

2. Description of Related Art

Beach chairs provide temporary places for people to sit and rest when they are camping, fishing or playing on a beach. To prevent sunburns and receiving excessive rays from the sun, most beach chairs are equipped with a sunshade. With reference to FIG. 9, a conventional foldable beach chair (50) comprises a seat (51), a backrest (52), legs (54), armrests (55) and a sunshade (60). The backrest (52) includes a U-shaped tubular frame (53) with a horizontal top (not numbered) and two essentially vertical sides (not numbered). The sunshade (60) has a shaft (61) and a securing device (70) that clamps on or otherwise attaches to the tubular frame (53).

The seat (51), the backrest (52), the legs (54) and the armrests (55) are connected together to form a chair body and are foldable so the chair can be stored or carried easily. The sunshade (60) is attached to the top of the backrest (52) frame (53) by the securing device (70).

The securing device (70) comprises a C-shaped frame (71) and a threaded drive rod (72) movable mounted in the C-shaped frame (71). The C-shaped frame (71) has an upper arm (711), a lower arm (712) and an opening (not numbered) between the upper arm (711) and the lower arm (712) for receiving the top of the backrest (52) frame (53). The upper arm (711) of the C-shaped frame (71) has an outer edge (not numbered) and an inner face (not numbered). A stationary jaw (not numbered) is formed on the inner face of the upper arm (711). The shaft (61) is securely attached to the outer edge of the upper arm (711). A threaded through hole (not numbered) is formed in the lower arm (712) through which the threaded drive rod (72) is screwed. The threaded drive rod (72) has an outer end (not numbered) and an inner end (not numbered). A handle (not numbered) is formed on the outer end. A moveable jaw (73) corresponding to the stationary jaw is rotatably attached to the inner end of the threaded drive rod (72). When the top of the backrest (52) frame (53) is placed between the stationary jaw and the moveable jaw (73) and the moveable jaw (73) is tightened on the frame (53), the sunshade (60) is detachably attached to the backrest (52).

However, such a conventional beach chair (50) has the following drawbacks.

1. The beach chair is inconvenient to carry.

When carrying the beach chair, the chair body and the sunshade (60) are usually carried separately. That is often inconvenient because people going to the beach often have many things to carry. Because of how the sunshade (60) is attached to the backrest (52), carrying the beach chair with the sunshade (60) attached to the frame (53) is cumbersome.

2. The incline angle of the sunshade cannot be adjusted to meet the needs of a person sitting in the beach chair.

The securing device (70) only can adjust the incline angle of the sunshade (60) in the plane perpendicular to the top of backrest (52) frame (53). Additionally, the securing device (70) protrudes from the frame (53) and can be uncomfortable to a person sitting in the beach chair and leaning against the backrest (52).

The present invention has arisen to mitigate and/or obviate the disadvantages of the conventional beach chair.

SUMMARY OF THE INVENTION

The main objective of a beach chair with a sunshade in accordance with the present invention is that the sunshade is adjustable in any plane passing through the connection point due to the novel design of the securing device.

The other objective of the beach chair with a sunshade is to make the beach chair convenient to carry.

Further benefits and advantages of the present invention will become apparent after a careful reading of the detailed description with appropriate reference to the accompanying drawings.

DETAILED DESCRIPTION OF THE INVENTION

Figure 1:
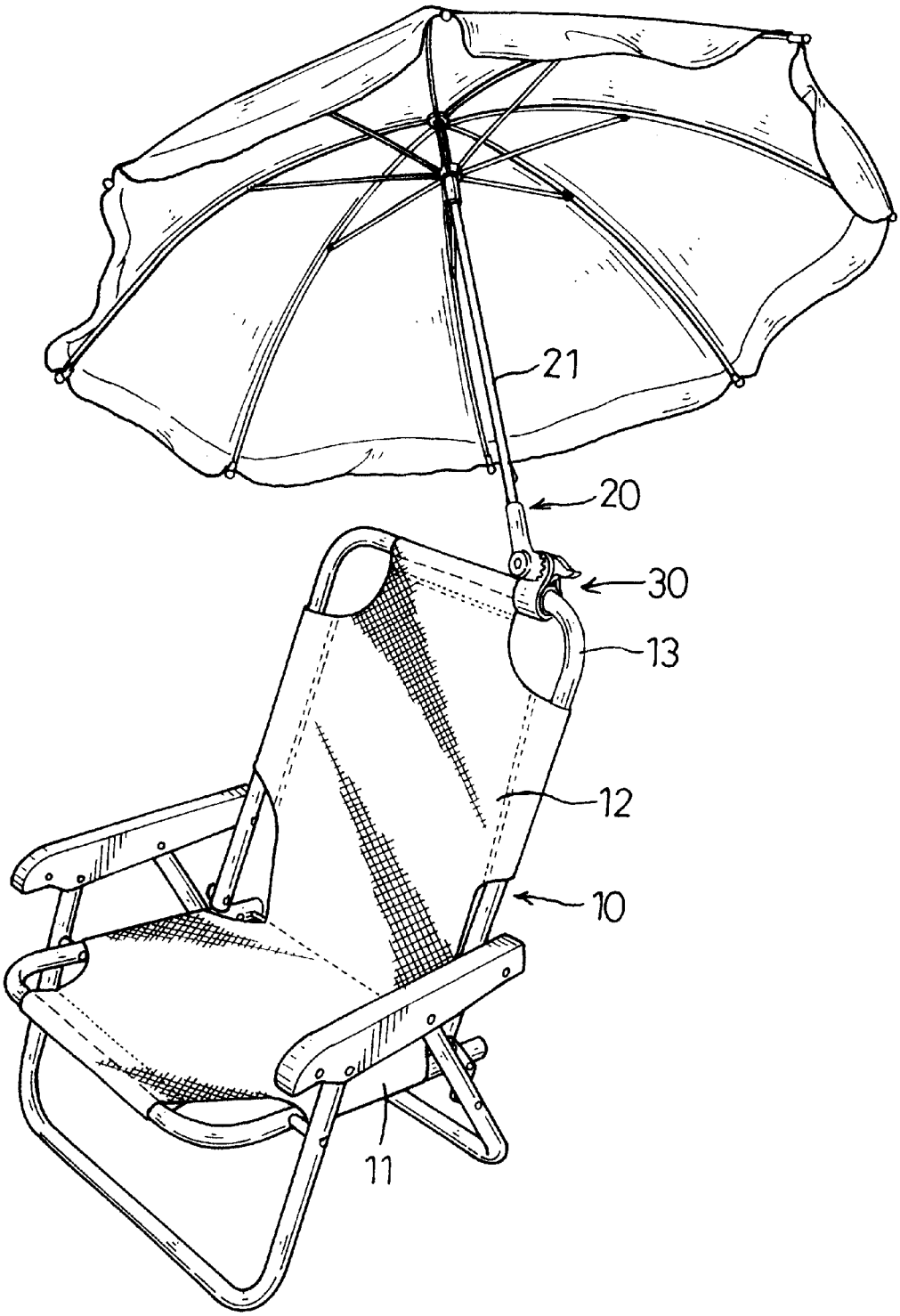
FIG. 1 is a perspective view of a beach chair with a sunshade in accordance with the present invention.
Figure 2:
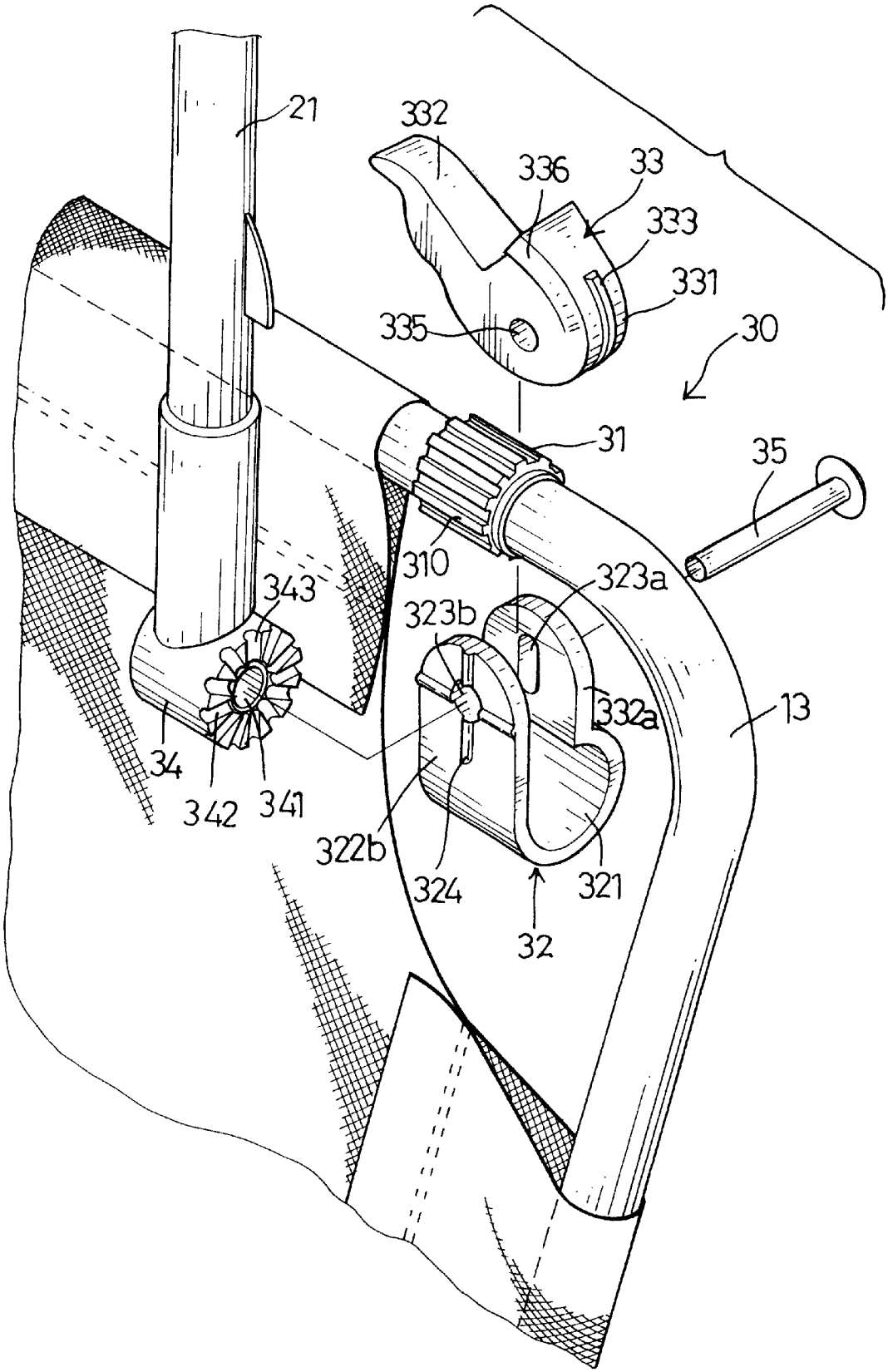
FIG. 2 is an enlarged exploded perspective view of the securing device to attach the sunshade and the backrest in FIG. 1.

With reference to FIGS. 1 and 2, a beach chair with a sunshade in accordance with the present invention comprises a chair (10), a sunshade (20) and a securing device (30).

The chair (10) is essentially a conventional folding chair with short legs (14), comprises a seat (11), a backrest (12), short legs (14) and optionally armrests (15) and is foldable by any possible design. The seat (11) and backrest (12) are mounted on U-shaped tubular frames (13), and the backrest (12) frame (13) has a horizontal top (not numbered) and two essentially vertical sides (not numbered). The seat (11) and the backrest (12) are pivotally attached to each other so the beach chair can be folded.

The sunshade (20) is also essentially conventional and has a shaft (21) to connect to the securing device (30). Consequently, specific details regarding the chair (10) and the sunshade (20) are not provided except as they refer to the combination of three primary elements and the beach chair as a whole. The embodiment in the figures is for illustrating purposes only.

The securing device (30) is made of resilient material and comprises a toothed ring (31), a locking collar (32), a locking block (33), a ratchet wheel (34) and a pivot pin (35). The toothed ring (31) has an outer periphery and is mounted around the top of the backrest (12) frame (13). Multiple grooves (310) are defined longitudinally on the outer periphery of the toothed ring (31). The locking collar (32) has a cylindrical recess (321) and an opening (not numbered) longitudinally defined in the locking collar (30). The cylindrical recess (321) is able to either securely clamp or freely rotate around the toothed ring (31). The opening communicates with the cylindrical recess (321) to provide the means for the toothed ring (31) to be inserted into the cylindrical recess (321). A first ear (322*a*) and second ear (322*b*) extend from at opposite edges of the opening in the locking collar (32). The ears (322*a*, 322*b*) are parallel to each other. An elongated hole (323*a*) is defined in the first ear (322*a*), and a round hole (323*b*) is defined in the second ear (322*b*) and is aligned with the elongated hole (323*a*) in the first ear (322*a*). The second ear (322*b*) has an outer face (not numbered) and multiple detents (324) are formed radically around the round hole (323*b*) on the outer face. For purposes of illustration, four detents (324) are shown in the figures.

The locking block (33) is rotatably secured between the first ear (322*a*) and the second ear (322*b*) and selectively meshes with the toothed ring (31). The locking block (33) has a locking head (331) and a lever (332) integrally formed with the locking head (331). The locking head (331) has a curved edge (not numbered) and two flat sides (not numbered). Arcuate wedges (336) are respectively formed on opposite flat sides. The locking head (331) is rotatably mounted between the first ear (322*a*) and the second ear (322*b*) of the locking collar (32) and has a key (333) formed on the curved edge, which corresponds to the grooves (310) in the toothed ring (31). A through hole (335) is defined through the locking head (331) at an eccentric location relative to the locking head (331). The through hole (335) is aligned with the holes (323*a*, 323*b*) in the ears (322*a*, 322*b*) when the locking block (33) is mounted between the ears (322*a*, 322*b*).

The ratchet wheel (34) is connected to the shaft (21) of the sunshade (20) and has a contact face (343) that abuts the outer face of the second ear (322*b*). The contact face (343) is circular and has a center. A hole (341) is defined in the center of the contact face (343), and multiple detent grooves (342) corresponding to the detents (324) of the locking collar (32) are radically defined on the contact face (343) around the hole (341).

The pivot pin (35) is used to pivotally mount the locking block (33) between the ears (322*a*, 322*b*) of the compression collar (32) and rotatably mount the ratchet wheel (34) against the outside face of the second ear (322*b*). The pivot pin (35) has two ends with an enlarged head (not numbered) on one end. The pivot pin (35) passes through the elongated hole (323*a*) in the first ear (322*a*), the through hole (335) in the locking block (33) and the round hole (323*b*) in the second ear (322*b*), and is secured in the hole (341) in the ratchet wheel (34).

Figure 4:
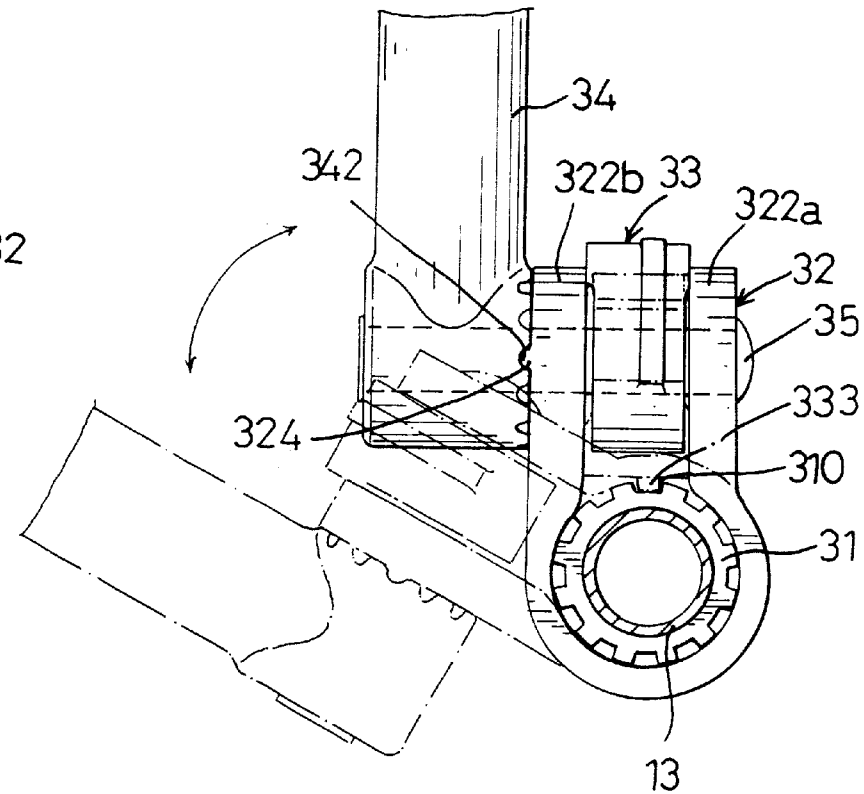
FIG. 4 is an enlarged operational side plan view of a ratchet and a locking collar of securing device in FIG. 1.
Figure 3:
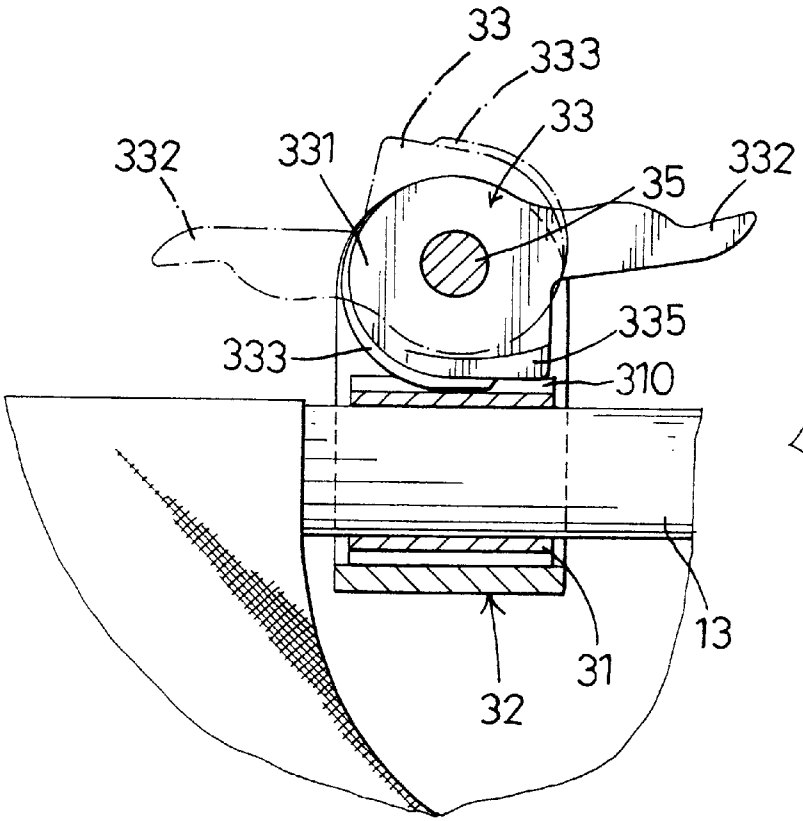
FIG. 3 is an enlarged operational side plan view of the locking block of the securing device in FIG. 1.

With reference to FIGS. 3 and 4, the locking block (33) is rotatably mounted on the toothed ring (31). The lever (332) is used to rotate the locking head (331) and lock the locking block (33) and attached elements to the locking collar (32) or unlock them from the locking collar (32). Specifically with reference to FIG. 3, The locking block (33) drawn in dotted line shows the lever (332) in an unlocked position with the key (333) disengaged from the grooves (310) on the toothed ring (31) and facing upward. The locking collar (32) is free to rotate around the upper frame (13). In other words, the sunshade (20) can be rotated around the upper frame (13) of the back rest (12). When the lever (332) is at the position shown in solid lines, the arcuate wedges (336) press against the inside of the ears (322*a*), (322*b*) to firmly secure the ratchet wheel (34) with the second ear (322*b*) of the locking collar (32). Simultaneously, the key (333) faces down to mate with one of the grooves (310) of the toothed ring (31), which locks the locking block (33) to the locking collar (32) so the sunshade (20) can be positioned at an optimum angle to shade a person sitting in the chair (10).

Figure 5:
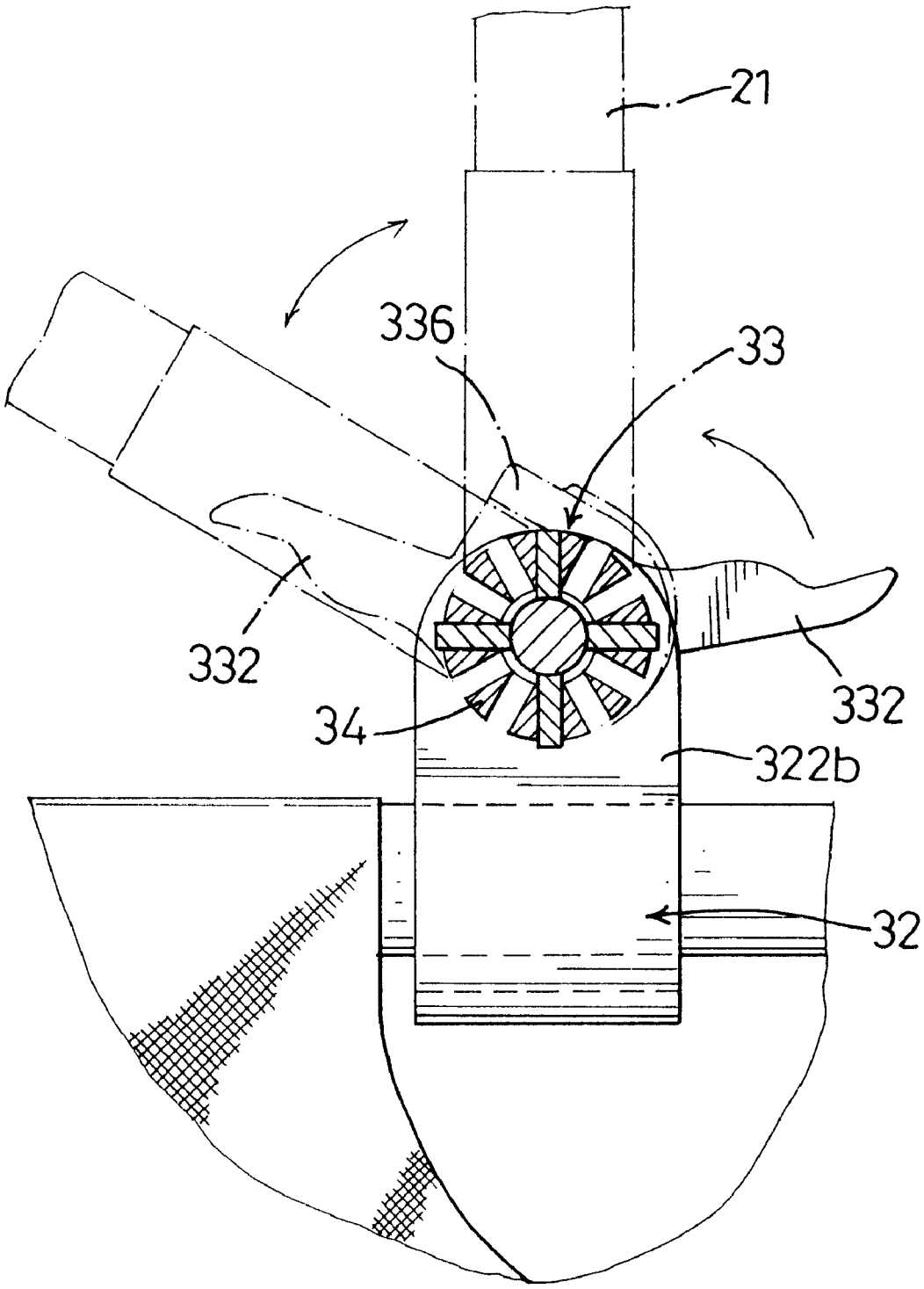
FIG. 5 is an enlarged operational side plan view of the sunshade securing device in FIG. 1.

With reference to FIG. 5, the dotted line shows the lever (332) in the unlocked position where the key (333) is facing upward and the ratchet wheel (34) is free to rotate on the outer face of the second ear (322*b*). With the lever (332) in this position, the sunshade (20) can be pivoted in a plane that passes through the upper frame (13) of the backrest (12). When the lever (332) is in the locked position shown in solid lines, the arcuate wedges (336) press against the inside of the ears (322*a*, 322*b*) and spread the ears (322*a*, 322*b*) to make the multiple detents (324) on the second ear (322*b*) press into the corresponding detent grooves (342) in the ratchet wheel (34), whereby locking the ratchet wheel (34) in position to hold the sunshade (20) at an optimum angle to shade a person sitting in the chair (10).

Figure 6:
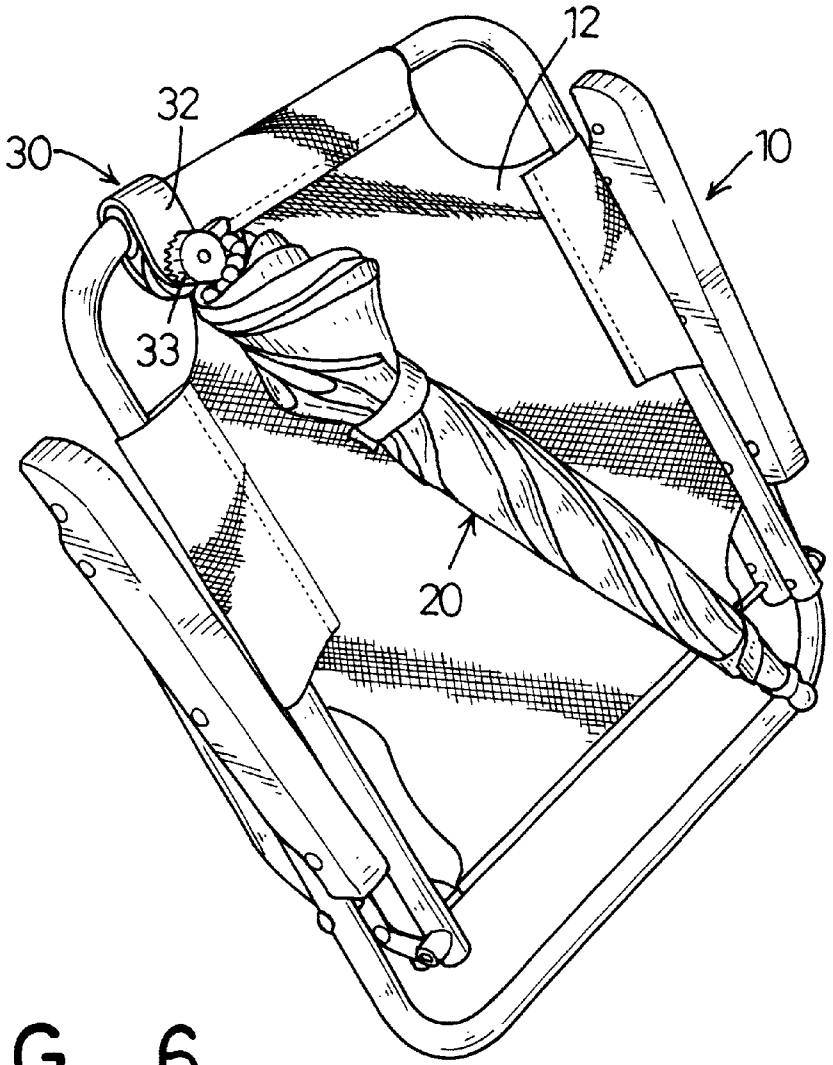
FIG. 6 is a perspective view of the folded beach chair in accordance with the present invention.

With reference to FIG. 6, the sunshade (20) can be folded and held against the backrest (12) because the securing device (30) does not detach from the chair (10) and can be adjust in two directions. Thus, the sunshade (20) can be conveniently carried with the chair (10) and not waste space when the beach chair is folded or even opened.

Figure 7:
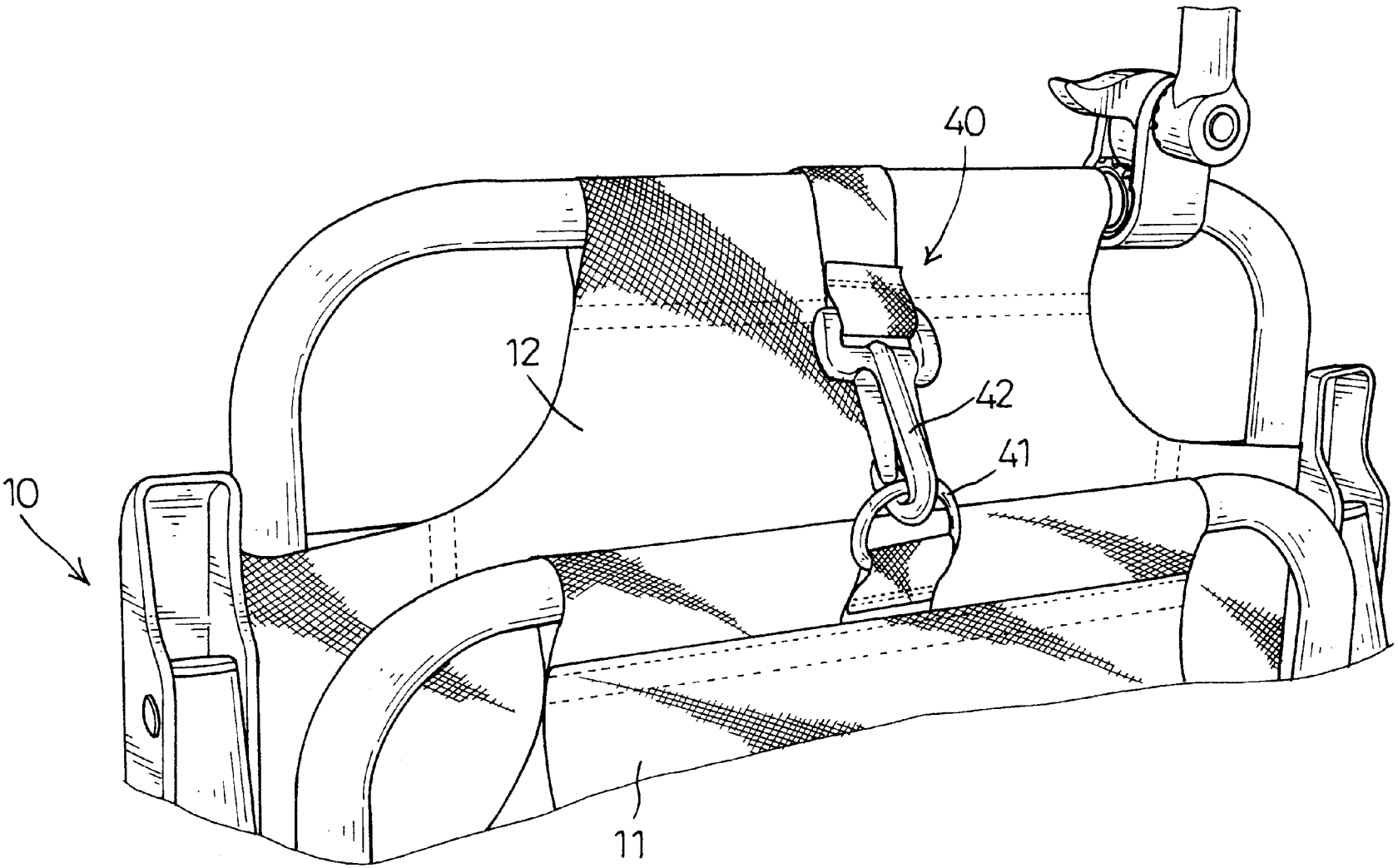
FIG. 7 is an enlarged perspective view of a clasp used with the beach chair in FIG. 6.

With reference to FIG. 7, a clasp (40) is attached to the chair (10) between the seat (11) and the backrest (12). The preferred embodiment of the clasp (40) has a locking ring (41) and a snap hook (42) attached to the seat (11) and the backrest (12), respectively. The snap hook (42) attaches to the locking ring (41) to hold the seat (11) and the backrest (12) together when the chair (10) is folded. Therefore, the chair (10) does not inadvertently open and cause unexpected injury to users.

Figure 8:
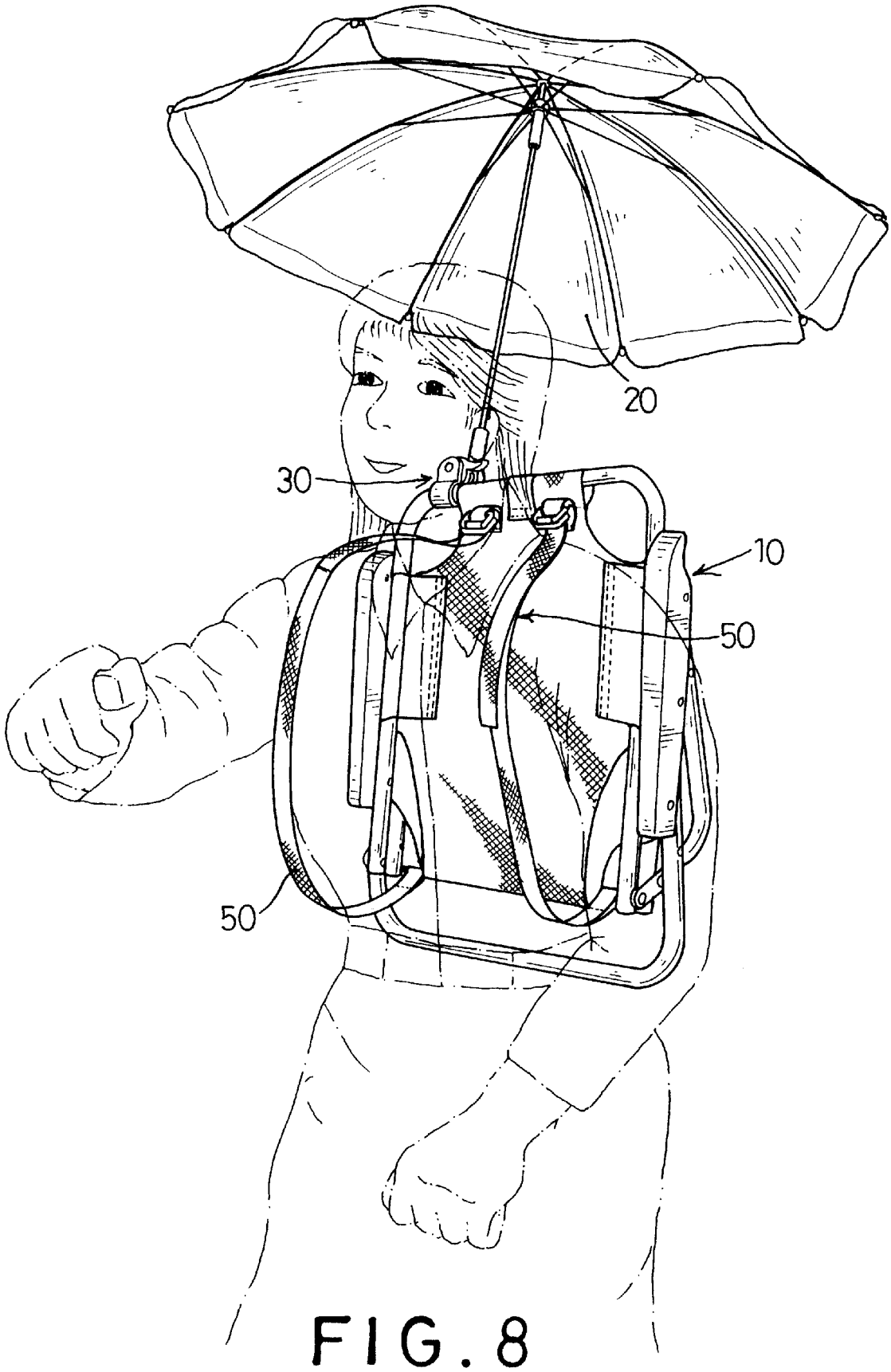
FIG. 8 is an operational perspective view of the beach chair in FIG. 6 with straps for carrying the beach chair.
Figure 9:
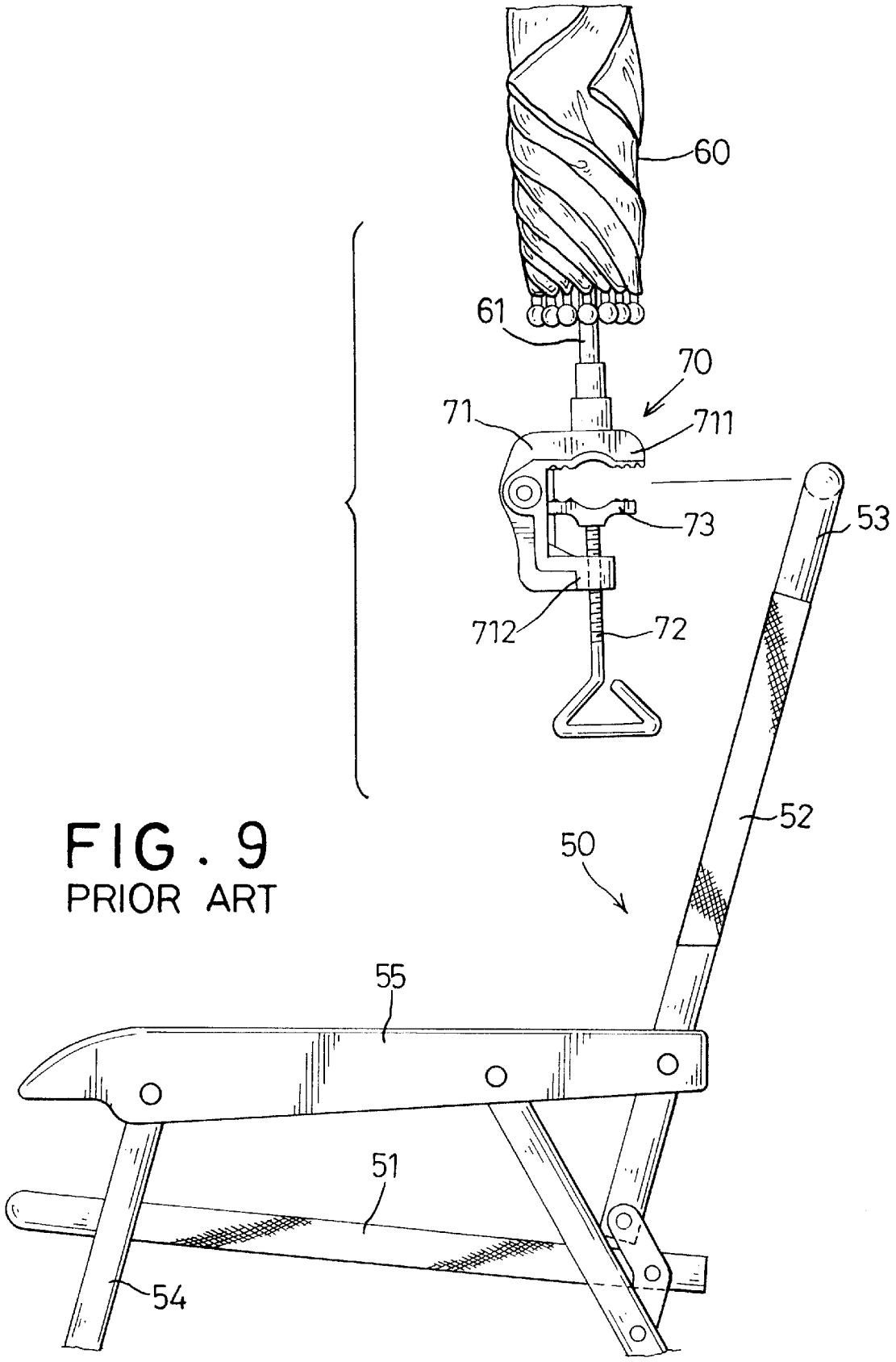
FIG. 9 PRIOR ART
FIG. 9 is a partially exploded side plan view of a conventional foldable beach chair in accordance with the prior art.

With reference to FIG. 8, shoulder straps (45) are attached to the chair (10) so people can carry the whole beach chair with a sunshade on their backs. When a person is carrying the folded beach chair on his or her back, the sunshade (20) can be opened to shade the person carrying the beach chair.

According to above description, it is easily understood that by attaching the securing device (30) of the beach chair with a sunshade in accordance with the present invention, the beach chair is efficiently adjustable in two directions at different angles to position the sunshade (20) at a optimum inclination to shade the sunlight. The sunshade (20) does not easily detach from the chair (10), which makes carrying the beach chair easy.

Although the invention has been explained in relation to its preferred embodiment, it is to be understood that many other possible modifications and variations can be made without departing from the spirit and scope of the invention as hereinafter claimed.

What is claimed is:

1. A beach chair with a sunshade comprising:

a foldable chair (10) comprising a seat (11), a backrest (12) having an upper frame (13), legs (14) and optionally armrests (15);

a sunshade (20) having a shaft (21); and a securing device (30) mounted between the foldable chair (10) and the sunshade (20);

wherein the improvements of the beach chair with a sunshade comprise:

the securing device (30) being made of resilient material and comprising:

a toothed ring (31) mounted around the upper frame (13) of the backrest (12) and having multiple grooves (310) defined on an outer periphery of the tooth ring (31);

a locking collar (32) rotatably mounted around the toothed ring (31) and having a cylindrical recess (321) with an opening for securing the toothed ring (31) inside the cylindrical recess (321); a first ear (322*a*) and a second ears (322*b*) extending from the locking collar (32) respectively and parallel with each other, the second ear (322*b*) having an outer face and at least one detent (324) formed on the outer face;

a locking block (33) pivotally secured between the first ear (322*a*) and the second ear (322*b*) and movably mounted on the toothed ring (31), the locking block (31) having a locking head (331) and a lever (332) connected to the locking head (331);

wherein the locking head (331) comprises a curved edge, a key (333) formed on the curved edge to correspond to one of the grooves (310) in the toothed ring (31), and arcuate wedges (335) respectively formed on opposite sides of the locking head (331) to press the ears (332*a,* 322*b*) on the compression collar (32) apart; and a ratchet wheel (34) connected to the shaft (21) of the sunshade (20) and rotatably mounted on the second ear (322*b*) of the locking collar (32), the ratchet wheel (34) having a contact face (343) with a center to abut the second ear (322*b*) and multiple detent grooves (342) radically defined on the contact face (343) to correspond to the at least one detent (324) on the locking collar (32).

2. The beach chair with a sunshade as claimed in claim 1, wherein an elongated hole (323*a*) is defined in the first ear (322*a*);

a round hole (323*b*) is defined in the second ear (322*b*);

a through hole (335) is defined in the locking head (331) of the locking block (33); and a hole (341) is defined at the center of the detent grooves (342) in the contact face (343) of ratchet wheel (34);

wherein a pivot pin (35) with two ends and a head formed on one end passes through the elongated hole (323*a*) in the first ear (322*a*), the through hole (335) in the locking block (33) and the round hole (323*b*) in the second ear (322*b*) and is secured in the hole (341) in the ratchet wheel (34).

3. The beach chair as claimed in claim 2, which further comprises a clasp (40) attached between the seat (11) and the backrest (12).

4. The beach chair as claimed in claim 3, wherein the clasp (40) comprises a snap hook (41) and a locking ring (42) secured on the seat (11) and the backrest (12), respectively.

5. The beach chair as claimed in claim 4, wherein the backrest (12) further has two shoulder straps attached to the backrest (12).

6. The beach chair as claimed in claim 3, wherein the backrest (12) further has two shoulder straps attached to the backrest (12).

7. The beach chair as claimed in claim 2, wherein the backrest (12) further has two shoulder straps attached to the backrest (12).

8. The beach chair as claimed in claim 1, which further comprises a clasp (40) attached between the seat (11) and the backrest (12).

9. The beach chair as claimed in claim 8, wherein the clasp (40) comprises a snap hook (41) and a locking ring (42) secured on the seat (11) and the backrest (12), respectively.

10. The beach chair as claimed in claim 1, wherein the backrest (12) further has two shoulder straps attached to the backrest (12).

* * * * *